United States Patent [19]

Michaels

[11] Patent Number: 4,923,413

[45] Date of Patent: May 8, 1990

[54] ENVIRONMENTALLY SEALED ELECTRICAL CONNECTOR

[75] Inventor: Leonard H. Michaels, St. Charles, Ill.

[73] Assignee: Molex Incorporated, Lisle, Ill.

[21] Appl. No.: 242,853

[22] Filed: Sep. 12, 1988

[51] Int. Cl.[5] ..... H01R 13/40

[52] U.S. Cl. ..... 439/589; 439/284; 439/680; 439/730; 439/289

[58] Field of Search ..... 439/271, 281, 282, 316, 439/370, 371, 289, 586–589, 680, 681, 730, 284

[56] References Cited

U.S. PATENT DOCUMENTS

| | | | |
|---|---|---|---|
| 3,143,595 | 8/1964 | Martin | 439/730 |
| 3,594,695 | 7/1971 | Wofford | 439/284 |
| 4,595,251 | 6/1986 | Moulin | 439/680 |
| 4,758,174 | 7/1988 | Michaels et al. | 439/589 |

FOREIGN PATENT DOCUMENTS

| | | | |
|---|---|---|---|
| 2355873 | 5/1974 | Fed. Rep. of Germany | 439/289 |
| 2290056 | 5/1976 | France | 439/284 |

*Primary Examiner*—P. Austin Bradley

*Attorney, Agent, or Firm*—Louis A. Hecht; Stephen Z. Weiss

[57] ABSTRACT

A connector assembly comprises opposed mateable plug and receptable connectors. The plug and receptacle connectors each comprise identical hermaphroditic core insulators molded from an elastomeric material. The hermaphroditic core insulators comprise axially aligned terminal receiving slots extending generally radially inwardly into the outer circumference thereof. The mating end of the core insulator is of a stepped configuration to define a leading mating face and a trailing mating face, such that the leading mating face of one hermaphroditic core insulator is urged into mating face-to-face relationship with the trailing mating face of an opposed hermaphroditic core insulator. A generally cylindrical tubular shroud is disposed around the core insulator and the cable terminated therein. The shroud may be formed from a material that is heat shrunk into secure environmental sealing and strain relief connection with the core insulator and the cable.

8 Claims, 5 Drawing Sheets

ENVIRONMENTALLY SEALED ELECTRICAL CONNECTOR

BACKGROUND OF THE INVENTION

Design objectives for most electrical connectors include: low cost; manufacturing ease; assembly well suited for automation; strength; strain relief; and environmental sealing. In recent years, the miniaturization of electrical equipment and components often has made the size of electrical connectors become an overriding design objective. However, it has been difficult to design an acceptably small electrical connector that achieves the other well known design objectives, such as environmental sealing, ease of assembly, strain relief and such. In many instances, one or more design objectives have been sacrificed in an effort to achieve the overriding objective of a small electrical connector. Thus, many available miniature electrical connectors do not provide adequate environmental sealing, provide poor protection for the fragile electric connections therein, provide ineffective strain relief, or are difficult to assemble because of the size and fragility of the components.

One effective small environmentally sealed electrical connector is shown in co-pending application Ser. No. 005,045 now U.S. Pat. No. 4,758,174 which was filed by the inventor herein and which is assigned to the assignee of the subject application. Application Ser. No. 005,045 shows mateable connector halves. Each electrical connector half includes a plurality of terminals frictionally retained in longitudinally aligned apertures extending through a one-piece molded elastomeric insert. The elastomeric insert shown in co-pending application Ser. No. 005,045 preferably is molded from a material having a high coefficient of friction to enable both a secure frictional retention of the terminals therein, and to enable the respective elastomeric inserts to be frictionally retained in outer shells. The frictional retention of the elastomeric inserts in the outer shells helps to achieve environmental sealing, and further simplifies and facilitates the assembly of each half of the electrical connector. The disclosure of co-pending application Ser. No. 005,045 is incorporated herein by reference.

Despite the many advantages of the electrical connector shown in co-pending Application Ser. No. 005,045, it is desired to provide an electrical connector that is even easier and less expensive to manufacture and assemble.

It is an object of the subject invention to provide an alternative means of assembling terminals into the connector assembly, the advantages of which become more apparent as size is decreased.

It is a further object of the subject invention to provide an electrical connector that provides simple, inexpensive environmental sealing.

An additional object of the subject invention is to provide mateable electrical connector halves that are hermaphroditic to minimize inventory control problems and reduce manufacturing expenses, as well as to provide positive keying of the circuits.

Yet another object of the subject invention is to provide an electrical connector that provides exceptional environmental sealing and strain relief with a substantial minimum number of components.

SUMMARY OF THE INVENTION

The subject invention is directed to an electrical connector assembly which comprises a pair of mateable electrical connectors. Each electrical connector of the subject assembly comprises at least one terminal which is securely engaged in a centrally located core insulator. The core insulators of the respective electrical connectors of the assembly may be substantially identical, with the two identical core insulators defining a hermaphroditic mateable pair.

Each core insulator comprises a forward mating end and an opposed rearward end. The forward mating end of each core insulator may be of generally stepped configuration, with the step defining a generally diametrically aligned plane which includes or is parallel to the longitudinal axis of the core insulator. Thus, the forward mating end of the core insulator may define leading and trailing mating faces, each of which may be of generally D-shape. The diametrically disposed plane surface extending between the leading and trailing mating faces of the core insulator may be characterized by locking means for locking but releasable engagement of two such hermaphroditic core insulators in a mated condition. For example, the diametrically aligned plane surface at the forward end of the core insulator may comprise a detent or ridge disposed at an axial location to permit the detent or ridge of one hermaphroditic core insulator to lockingly but releasably engage the detent or ridge of the other core insulator.

Each core insulator preferably is unitarily molded from an elastomeric material. The elastomeric characteristics of the core insulator help to achieve the locking but releasable engagement of two hermaphroditic core insulators as noted above.

Each core insulator of the subject electrical connector defines terminal engaging portions. Preferably, the terminal engaging portions are defined by axially aligned inwardly extending slots disposed at one or more selected locations around the periphery of the core insulator. Each axially aligned slot in the elastomeric core insulator may include cross-sectional dimensions that permit the slot to resiliently engage a terminal therein. The temporary securement of a multiplicity of very small terminals in this manner until permanently secured in the final assembly, allows a normally tedious assembly to be made with ease.

The axially aligned terminal receiving slots may be disposed symmetrically with respect to the diametrically aligned plane at the forward mating end of the core insulator. For example, the core insulator may comprise a pair of axially aligned slots disposed symmetrically on opposite sides of the above referenced diametrically aligned plane extending between the leading and trailing mating faces at the forward end of the core insulator. Additionally or alternatively, the core insulator may comprise axially aligned slots symmetrically disposed at spaced apart locations on opposite longitudinal sides of the diametrically aligned plane.

The axial positioning of each terminal within the associated slot of the core insulator may be positively controlled by locking means disposed within the axially aligned slot for engaging corresponding structure on each respective terminal. For example, each terminal receiving slot may be molded to include a locking detent at a specified axial position therein. The detent in each slot may be dimensioned to engage a corresponding recess in each terminal.

The electrical connector further comprises a tube or shroud formed from a dielectric material and securely engaged around the outer circumference of the core insulator. The shroud functions to securely retain the terminals within the core insulator and provides electrical insulation for the terminals and the conductive leads extending thereto. The shroud includes a forward mating end and an opposed rearward cable engaging end. The mating end of the shroud is aligned with the trailing mating face of the core insulator on one electrical connector in the assembly comprised of a pair of mateable connectors. The mating end of the shroud on the other electrical connector in the mateable assembly is aligned with the leading mating face of the core insulator thereof. As will be described and illustrated in greater detail below, this axial orientation of the shrouds relative to the associated core insulators enables the respective mating ends of the shrouds to be in abutting end-to-end relationship when the electrical connectors are in their mated condition.

The core insulator and the shroud preferably are formed from materials which permit a tight environmentally sealed interface therebetween. In particular, the shroud may be formed from a material which shrinks when exposed to heat. Thus, the shroud may be telescopingly slid into position relative to the core insulator and relative to the associated cable, and then may be subjected to sufficient heat to achieve controlled shrinking of the shroud into tight environmentally sealed relationship with the core insulator and cable. The tight sealing with both the core insulator and the cable will further contribute to strain relief at the connector/cable interface. A removable dummy plug may be employed with the connector having the shroud which extends the full distance to the leading mating face of the core insulator to control the heat shrinkage.

In application, the connector having the forward end of the shroud aligned with the trailing mating face of the core insulator may be placed into an appliance having a hole with a diameter equal to or slightly less than the overall outer shroud diameter of the connector. With this assembly, the elastomeric characteristics of the core insulator can be relied upon to resiliently yield and enable a tight force fitting of the connector half in the hole of an appliance or the like. This resilient cork-like engagement further contributes to environmental sealing of the connector to the appropriate appliance, while the forward end of the appliance protects portions of the terminals that are not surrounded by the shroud.

DETAILED DESCRIPTION OF THE PREFERRED EMBODIMENT

Figure 1:
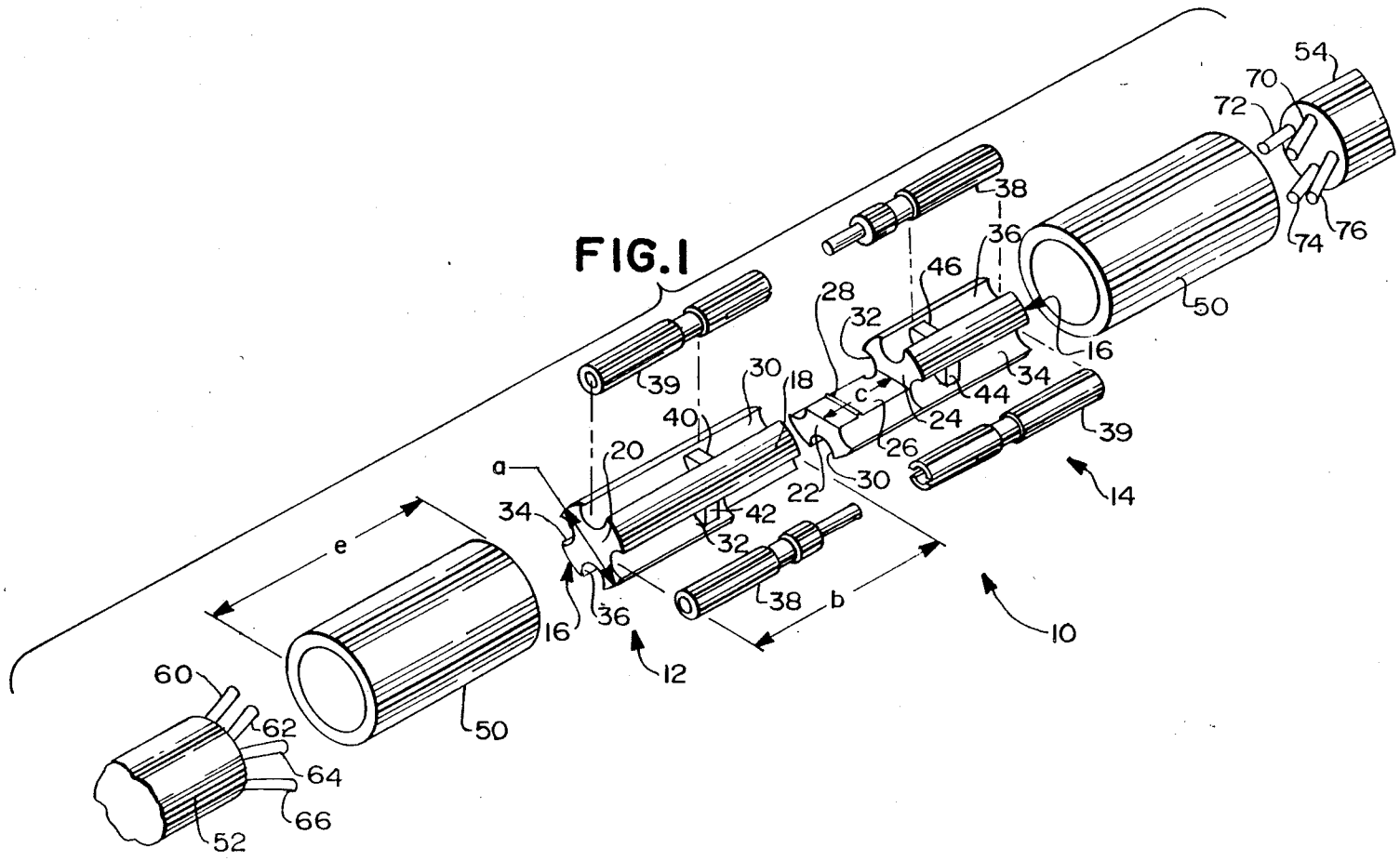
FIG. 1 is an exploded perspective view of a pair of mateable connectors in accordance with the subject invention.
Figure 2:
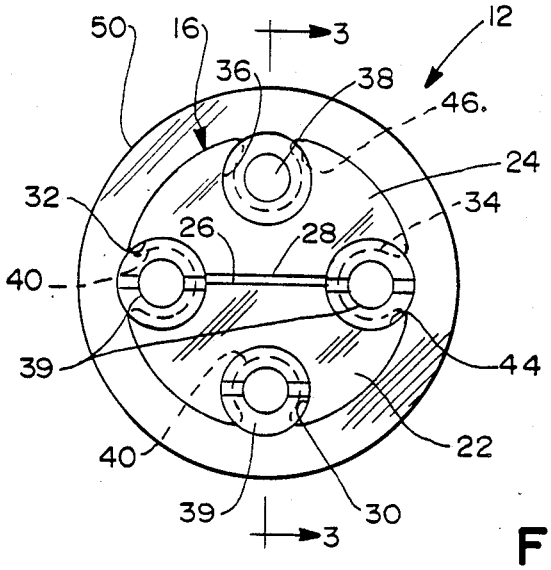
FIG. 2 is an end view of the assembled plug connector shown in FIG. 1.
Figure 4:
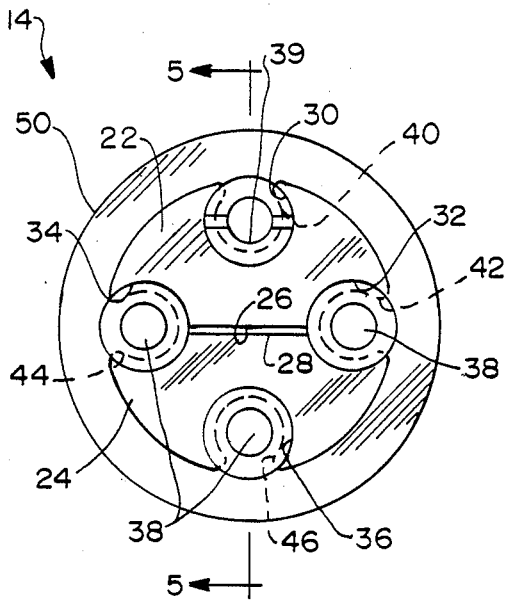
FIG. 4 is an end view of the assembled receptacle of the connector shown in FIG. 1.
Figure 5:
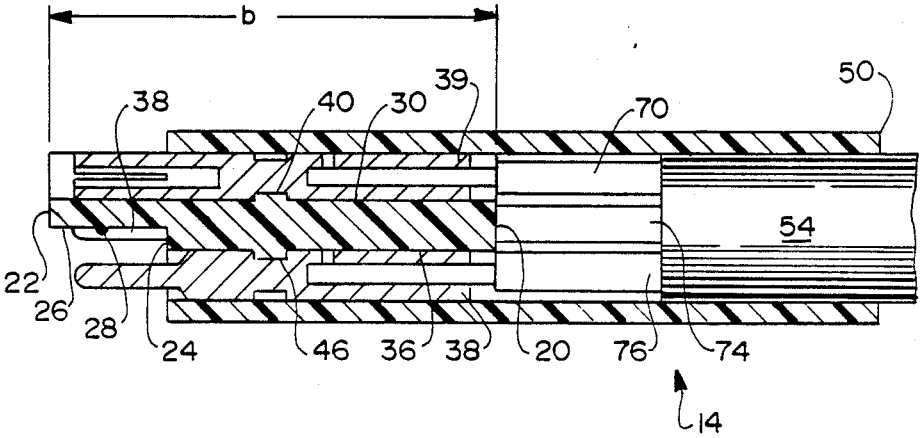
FIG. 5 is a cross-sectional view taken along line 5—5 in FIG. 4.

An electrical connector assembly in accordance with the subject invention is illustrated in FIG. 1, and is identified generally by the numeral 10. The electrical connector assembly 10 comprises a pair of mateable electrical connectors 12 and 14. In particular, the connector 12 defines a plug connector which is further illustrated in FIGS. 2 and 3. The connector 14 defines a receptacle connector, which is further illustrated in FIGS. 4 and 5.

The plug and receptacle connectors 12 and 14 each are provided with identical hermaphroditic core insulators 16. The hermaphroditic core insulators 16 are unitarily molded from an elastomeric material, such as a HYTREL polyester elastomer having a SHORE A durometer hardness of 60 to provide a high coefficient of friction and to provide a desirable degree of resiliency.

Each hermaphroditic core insulator 16 is of generally cylindrical configuration with an outer circumferential surface 18 defining a diameter "a" which may be about 0.125 inch, and opposed longitudinal ends defining a total length "b" which may be about 0.370 inch. The rearward longitudinal end 20 of the core insulator 16 is substantially planar, and is aligned substantially orthogonal to the longitudinal axis of the core insulator 16. The opposed forward longitudinal end of the core insulator 16, however, is of a stepped configuration to define a leading mating face 22, a trailing mating face 24 and a surface 26 extending therebetween and having an axial length "c" of about 0.100 inch.

The leading and trailing mating faces 22 and 24 are of substantially identical generally D-shape, and define planes extending orthogonal to the longitudinal axis of the core insulator 16. The surface 26, however, defines a generally diametrically aligned plane substantially passing through the longitudinal axis of the core insulator 16. The connector halves cannot be mated unless surfaces 26 are at identical clocking positions. Thus, proper circuit orientation or keying is assured.

Figure 3:
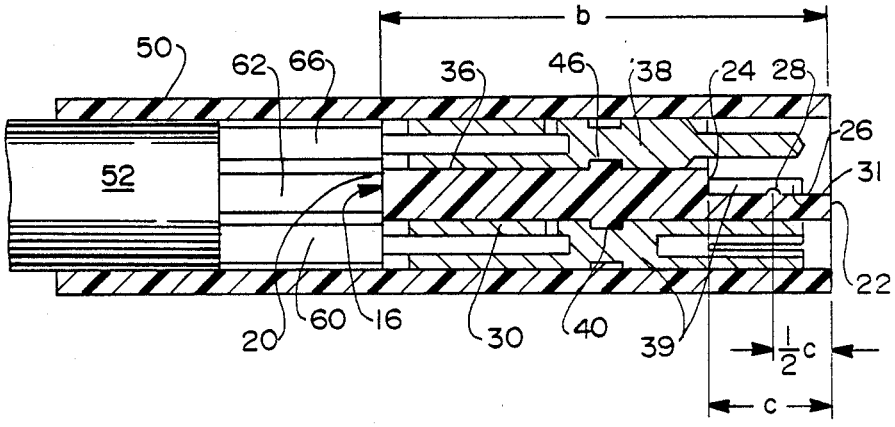
FIG. 3 is a cross-sectional view taken along line 3—3 in FIG. 2.

The surface 26 is characterized by a resilient locking ridge 28 extending orthogonal to the longitudinal axis of the core insulator 16 and spaced slightly closer to the leading mating end 22 than to the trailing mating end 24 as shown in FIG. 3. As will be explained further below, the construction of the core insulator 16 enables a pair of identical core insulators 16 to be hermaphroditically mated with the locking ridges 28 thereof releasably engaging one another and with the leading mating face 22 of one core insulator 16 being in abutting relationship to the trailing mating face 24 of the identical opposed core insulator 16.

The core insulators 16 each are formed to include four axially extending terminal receiving slots 30, 32, 34 and 36 which extend generally radially inwardly from the outer circumferential surface 18 of the core insulator 16. The slots 30–36 are disposed symmetrically with respect to the diametrically aligned surface 26. In particular, the terminal receiving slot 30 is aligned to intersect the leading mating face 22 at a central circumferential position thereon. The slots 32 and 34 are aligned to symmetrically intersect opposed sides of the diametrical surface 26. The slot 36 is disposed to intersect the trailing mating face 24 at a centrally disposed circumferential position thereon. Thus, the respective terminal receiving slots 30–36 are angularly spaced from one another by 90°.

The terminal receiving slots 30–36 are dimensioned to enable pin or socket terminals 38 or 39 to be urged in generally radial directions into secure resilient engagement in the terminal receiving slots 30–36. The resilient engagement of the terminals 38, 39 in the slots 30–36 is achieved by the resilient characteristics of the elastomeric material from which the core insulators 16 are molded. The axial position of the terminals 38, 39 in the respective core insulators 16 is positively determined by outwardly extending detents 40–46 in each of the respective slots 30–36. More particularly, each detent 40–46 is dimensioned to engage a corresponding notch structure in each respective pin or socket terminal 38, 39 to positively control the axial position of the pin or socket terminals 38, 39 relative to the core insulators 16.

The connector assembly 10 further comprises a pair of substantially identical shrouds 50 which are of substantially cylindrical tubular configuration. More particularly, each shroud 50 defines an internal diameter "d" which approximately equals or exceeds the external diameter "a" of the core insulator 16. Thus, the shroud 50 easily can be telescopingly slid over a corresponding core insulator 16 as explained further below. The shroud 50 further defines a length "e" that substantially exceeds the length "b" of the core insulator 16. Thus, when the shroud 50 is telescopingly slid over a core insulator 16, an axial end of the shroud 50 can be aligned with the leading mating face 22 of the core insulator 16, while still enabling the opposed axial end of the shroud 50 to extend substantially beyond the rearward end 20 of the core insulator 16. As will be explained and illustrated further below, the portion of the shroud 50 which extends beyond the rearward end 20 of the core insulator 16 will surround and engage a cable 52 or 54.

The shroud 50 is extruded or otherwise formed from a plastic material that shrinks upon exposure to heat. In particular, the preferred shroud 50 is formed from a polyolefin. The heat shrinking characteristics of the shroud 50 enable the shroud 50 to be slidably inserted over a core insulator 16 and over a portion of a cable 52, 54, and heat shrunk into tight environmentally sealing and stress relieving connection therewith.

The connector assembly 10 is electrically and mechanically joined to cables 52 and 54 to permit electrical connection therebetween. In particular, the cable 52 comprises four insulated leads 60–64 which are appropriately dressed to expose the conductors therein. The leads 60–64 are electrically terminated to socket terminals 39, while the lead 66 is electrically terminated to a pin terminal 38. The terminated leads 60–66 are then snapped into resilient engagement in the terminal receiving slots 30–36 respectively of the elastomeric core insulator 16. Thus, the slots 30–34 resiliently engage socket terminals 39 therein, while the slot 36 resiliently engages a pin terminal 38 therein. In this mounted condition of the terminals, the pin terminal 38 of the plug connector 12 will extend forwardly beyond the trailing mating face 24 of the core insulator 16 and generally parallel to the diametrical surface 26 thereof. The socket terminals 39 will terminate slightly rearwardly from the leading mating face 22, and will be at least partly enclosed and protected by portions of the core insulator 16 disposed intermediate the leading and trailing mating faces 22 and 24 thereof. In this partially assembled condition, the insulated portion of the cable 52 will be spaced slightly from the rearward end 20 of the core insulator 16.

Assembly of the plug connector 12 continues by sliding the tubular shroud 50 axially over the core insulator 16 and partly over the insulated portion of the cable 52. The forward end of the shroud 50 is placed in an axial alignment with the leading mating face 22 of the core insulator 16. A generally semicylindrical dummy plug having a diameter "a" equal to that of the core insulator 16 is then placed in mating engagement with the trailing mating face 24 of the plug connector 12. The plug connector 12 is then subjected to heat sufficient to shrink the shroud 50 into tight environmentally sealed strain relief connection with both the core insulator 16 and the cable 52. The heat shrunk shroud 50 simultaneously secures, protects and insulates the terminals 38, 39 in the plug connector 12.

The receptacle connector 14 is assembled in a manner similar to the plug connector 12 described above. More particularly, the leads 70–76 of the cable 54 are appropriately dressed for termination. The leads 72–76 are electrically and mechanically connected to the pin terminals 38, while the lead 70 is electrically and mechanically connected to a socket terminal 39. The terminated leads 70–76 are then snapped into engagement in the corresponding terminal receiving slots 30–36 respectively of an elastomeric core insulator 16. As noted above, the resilient characteristics of the elastomeric core insulator 16 securely retain the terminals 38 and 39 therein. Additionally, the axial position of each terminal 38 and 39 is determined by the detents 40–46 formed within the respective slots 30–36. The shroud 50 is then telescopingly slid over the core insulator 16 and a portion of the cable 54. However, unlike the above described plug connector 12, the leading end of the shroud 50 is placed generally in alignment with the trailing mating face 24 of the core insulator 16. The opposed end of the shroud 50 surrounds a portion of the cable 54. The receptacle connector 14 is then subjected to sufficient heat to cause the shroud 50 to shrink into tight environmental sealing and strain relief connection with both the core insulator 16 and the cable 54.

The plug connector 12 and the receptacle connector 14 can be urged into a substantially splash proof locked connection by merely urging the mating ends of the connectors 12 and 14 toward one another. In particular, with reference to FIGS. 2–5, it will be noted that the plug connector 12 is provided with three socket terminals 39 and one pin terminal 38, with the pin terminal thereof being disposed to extend centrally from the trailing mating face 24. The receptacle connector 14, on the other hand, comprises three pin terminals 38 and one socket terminal 39, with the socket terminal 39 being disposed generally centrally in the leading mating face 24 of the receptacle connector 14. With this orientation of pin and socket terminals 38 and 39, the axial movement of the plug and receptacle connectors 12 and 14 toward one another will cause the three socket terminals 39 and one pin terminal 38 of the plug connector 12 to electrically mate with the three pin terminals 38 and one socket terminal 39 of the receptacle connector 14. In the fully mated condition, the leading mating face 24 of one hermaphroditic core insulator 16 will be in abutting face-to-face contact with the trailing mating face 22 of the opposed hermaphroditic core insulator 16. In this fully mated condition, the ridges 28 of the opposed core insulators 16 will be in locking engagement with one another. Additionally, the alignment of the respective shrouds 50 is such that the shrouds 50 will be in abutting end-to-end contact in the mated condition of the connectors.

It should be emphasized that in the assembled connectors 12 and 14, the shrouds 50 perform multiple functions, including: the secure positive retention of the terminals 38, 39 in the respective hermaphroditic core insulator 16; insulation of the terminals 38, 39; environmental sealing and strain relief connection of both the hermaphroditic core insulators and the cables 52, 54 of each connector 12, 14; and environmental sealing of the assembled plug and receptacle connectors 12 and 14. It should also be emphasized that the connector assembly 10 provides extremely accurate and reliable assembly with minimal costs. Specifically, in addition to the terminated leads, each connector merely requires one of the identical hermaphroditic core insulators 16 and a simple tubular shroud 50 that can be heat shrunk into secure environmental sealing and strain relief connection to both the cables 52, 54 and the core insulator 16.

Figure 6:
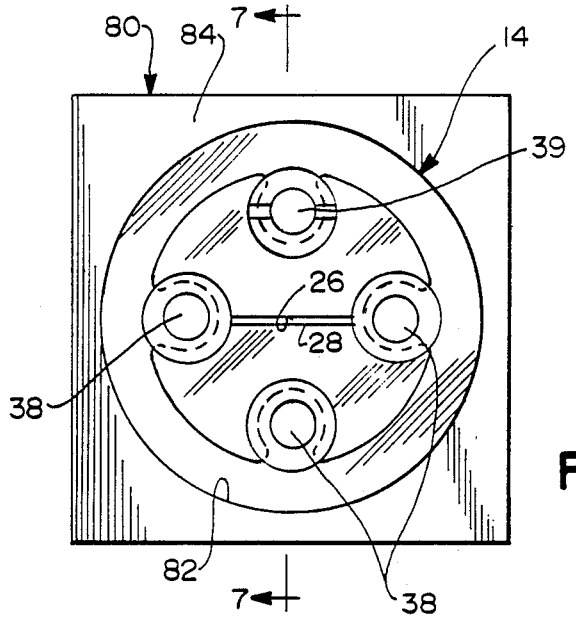
FIG. 6 is an end view of the receptacle connector mounted in an appliance.
Figure 7:
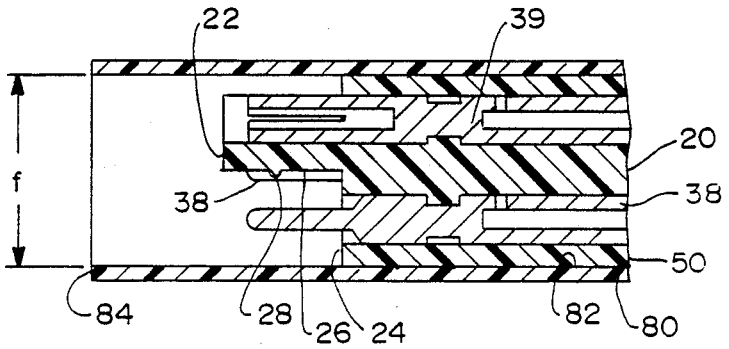
FIG. 7 is a cross-sectional view taken along line 7—7 in FIG. 6.
Figure 8:
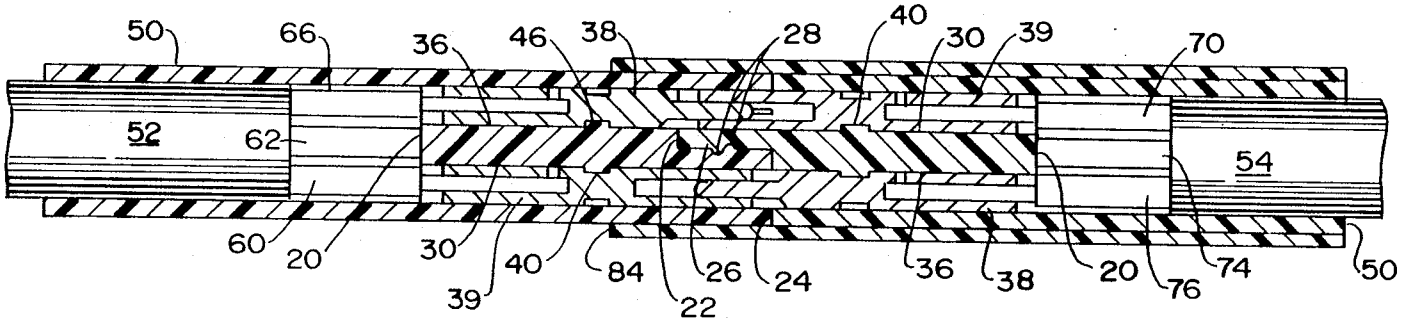
FIG. 8 is a cross-sectional view showing the plug connector of FIG. 3 mated with the receptacle connector of FIG. 7.

One possible use for the plug or receptacle connectors 12 and 14 identified above is illustrated in FIGS. 6–8. In particular, an elongated appliance 80 is provided having a longitudinally extending generally cylindrical aperture 82 extending therethrough from a leading end 84. The aperture 82 defines an internal diameter "f" which is substantially equal to or slightly less than the external diameter "g" of the assembled receptacle connector 14 with the heat shrunk shroud 50 thereon. The rsilient characteristics of the elastomeric core insulator 16 enable the receptacle connector 14 to be urged into force fit engagement within the aperture 82 of the appliance 80. The relative axial movement of the receptacle connector 14 and the appliance 80 is such that the leading end 84 of the appliance 80 is disposed forwardly of the leading mating face 24 of the core insulator 16 on the receptacle connector 14. Thus, the appliance 80 protects the exposed terminals of the receptacle connector 14. No corresponding protection is required for the plug connector, in view of the relative axial position of the shroud 50 on the core insulator 16 thereof, as shown most clearly in FIG. 3. The plug connector 12 can then be urged into the appliance 80 and into electrical and mechanical connection with the receptacle connector 14. Thus, the appliance 80 may further contribute to the environmental sealing and protection of the connector assembly 10.

While the invention has been described with respect to a preferred embodiment, it is apparent that various changes can be made without departing from the scope of the invention as defined by the appended claims.

I claim:

1. An electrical connector assembly comprising opposed mateable connectors, said connectors comprising substantially identical hermaphroditically mateable elongated core insulators, each core insulator having an outer surface and opposed forward and rear ends, generally axially aligned terminal receiving slots extending inwardly into the outer surface of said core insulators, the forward end of each said core insulator being defined by a leading mating face and a trailing mating face disposed in axially spaced generally parallel relationship to one another such that the leading mating face of the core insulator of one connector can be urged into opposed mating relationship with the trailing mating face of the core insulator of the other connector; electrically conductive terminals mounted in the slots of the respective core insulators, such that the terminals of one connector are electrically engageable with the terminals of the other connector when the mating faces of the respective core insulators are urged into mating relationship with one another; each connector further comprising a tubular shroud surrounding the respective core insulator thereof for insulating and retaining the terminals in said respective core insulator, each said shroud comprising a forward longitudinal end, with the forward end of the shroud of one said connector being generally axially aligned with the leading mating face of the core insulator thereof, and with the forward end of the shroud of the other said connector being generally axially aligned with the trailing mating face of the core insulator thereof.

2. A connector assembly as in claim 1 wherein each said respective core insulator is unitarily molded from an elastomeric material.

3. A connector assembly as in claim 1 wherein each said shroud is formed from a heat shrinkable plastic material, and is heat shrunk into tight sealing engagement with the associated core insulator.

4. A connector assembly as in claim 1 wherein each said shroud has an axial length substantially greater than the axial length of said core insulators, such that said shroud is heat shrinkably engageable with a cable extending to said electrical connector.

5. A connector assembly as in claim 1 wherein the connector having the forward end of the associated shroud aligned with the trailing mating face of the core insulator defines a receptacle connector, the receptacle connector further comprises an appliance having opposed leading and trailing ends and having a mounting aperture extending therethrough, said mounting aperture being dimensioned for tight frictional engagement with the outer circumference of the shroud of said receptacle connector, said receptacle connector being disposed relative to said appliance such that the leading mating face of the core insulator thereof is disposed between the leading and trailing ends of said appliance.

6. A connector assembly as in claim 1 wherein each said core insulator comprises a generally planar wall extending substantially through the longitudinal axis of said core insulator and extending between the leading and trailing mating faces thereof, said planar walls of said core insulators each comprising locking means for locking said core insulators in a mated condition.

7. A connector assembly as in claim 6 wherein the locking means comprises a resilient locking ridge molded unitarily with said core insulator and extending generally transverse to the longitudinal axis thereof, said ridges being axially disposed for locking engagement with one another in the mated condition of said core insulators.

8. An electrical connector comprising a generally elongated core insulator having an outer surface with generally axially aligned terminal receiving slots extending inwardly into the outer surface thereof, electrically conductive terminals engaged in the respective terminal receiving slots of said core insulator, where said core insulator comprises a stepped mating end defining a leading mating face and a trailing mating face axially spaced from one another; a tubular shroud in secure sealing engagement with the outer surface of said core insulator for insulating and retaining the terminals in said core insulator, where said shroud comprises a leading mating face disposed generally in alignment with the trailing mating face of said core insulator; and an elongated appliance having a forward end and an aperture extending therethrough from the forward end, said shroud of said connector being tightly engaged in the aperture of said appliance and being spaced inwardly from the forward end of said appliance.

* * * * *